US008858353B2

(12) United States Patent
Wiggins et al.

(10) Patent No.: US 8,858,353 B2
(45) Date of Patent: Oct. 14, 2014

(54) GOLF FLAGPOLE STAND

(75) Inventors: Dennis Wiggins, Kansas City, MO (US); Rick Wiggins, Branson, MO (US)

(73) Assignee: Double D Golf, LLC, Hermitage, MO (US)

( * ) Notice: Subject to any disclaimer, the term of this patent is extended or adjusted under 35 U.S.C. 154(b) by 229 days.

(21) Appl. No.: 13/500,840

(22) PCT Filed: Oct. 6, 2010

(86) PCT No.: PCT/US2010/051626

§ 371 (c)(1),
(2), (4) Date: Apr. 6, 2012

(87) PCT Pub. No.: WO2011/044233

PCT Pub. Date: Apr. 14, 2011

(65) Prior Publication Data

US 2012/0244956 A1 Sep. 27, 2012

Related U.S. Application Data

(60) Provisional application No. 61/278,356, filed on Oct. 6, 2009.

(51) Int. Cl.
*A63B 57/00* (2006.01)
*G09F 17/00* (2006.01)

(52) U.S. Cl.
CPC ..... *G09F 17/00* (2013.01); *A63B 57/00* (2013.01); *A63B 57/0056* (2013.01); *G09F 2017/0066* (2013.01)
USPC ..... 473/176; 248/170

(58) Field of Classification Search
CPC ..... A63B 55/10; A63B 57/00; A63B 57/056; A63B 57/062; F16M 11/26; F16M 11/28; F16M 11/32; F16M 13/02; A01K 97/10; G09F 17/00
USPC ..... 248/166, 168–171; 473/173–178
See application file for complete search history.

(56) References Cited

U.S. PATENT DOCUMENTS

| | | | | | |
|---|---|---|---|---|---|
| 578,809 | A | * | 3/1897 | Bronson | 248/457 |
| 663,761 | A | * | 12/1900 | Johnson | 473/176 |
| 1,198,766 | A | * | 9/1916 | Ramsay | 248/126 |
| 1,408,876 | A | * | 3/1922 | Frey | 206/315.3 |
| 4,898,352 | A | * | 2/1990 | Hoffman | 248/96 |
| 5,222,705 | A | * | 6/1993 | Gibran et al. | 248/170 |
| 5,255,627 | A | * | 10/1993 | Williams | 116/174 |
| 5,441,267 | A | | 8/1995 | Alder | |
| 5,482,247 | A | | 1/1996 | Smith | |
| 6,029,599 | A | | 2/2000 | Hiltner | |
| 6,955,609 | B1 | | 10/2005 | Hiltner et al. | |

(Continued)

*Primary Examiner* — Mark Graham
(74) *Attorney, Agent, or Firm* — Erickson Kernell Derusseau & Kleypas, LLC

(57) ABSTRACT

A stand for supporting a golf flagpole in an inclined position includes a collar rotatably secured to the shaft of the flagpole and one or more legs pivotably coupled to the collar. The one or more legs hang generally parallel to the shaft when the flagpole is in an upright position. When the flag of the flagpole is tipped toward the green, the one or more legs swing outwardly away from the shaft to a position generally perpendicular to the shaft to support the flagpole in an inclined position. Regardless of the position or direction that the legs are facing when the flag is tipped toward the green, the collar rotates so that the legs extend to the green to support the flagpole.

18 Claims, 7 Drawing Sheets

(56) References Cited

U.S. PATENT DOCUMENTS 7,487,948 B2 * 2/2009 Gardner ..... 248/688
2002/0070319 A1 * 6/2002 Yu ..... 248/122.1
2003/0102414 A1 * 6/2003 Smart ..... 248/170
2005/0272515 A1 12/2005 Hurley et al.

* cited by examiner

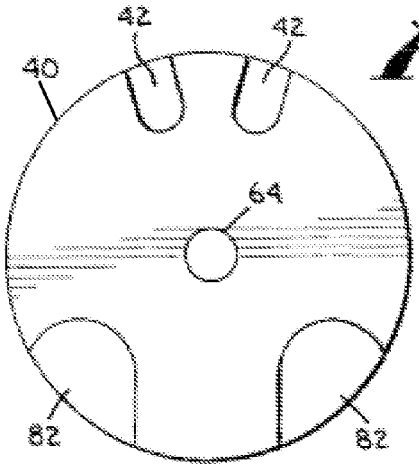
Fig.6.
Fig.7.
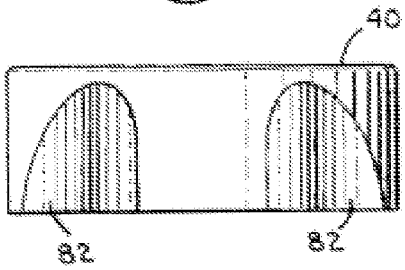

GOLF FLAGPOLE STAND

CROSS-REFERENCE TO RELATED APPLICATIONS

This application claims the benefit of application Ser. No. 61/278,356, filed on Oct. 6, 2009, entitled GOLF FLAG.

FIELD

The present invention relates to golf equipment, and more particularly, to an apparatus for use in combination with a golf flagpole or pin to prop-up the golf flagpole and provide a convenient rest for golf clubs.

BACKGROUND

When playing golf, the location of cup on the green is identified by the golf flagpole or pin. When putting, the pin must be removed from the cup. Typically, the pin is dropped on the green away from the putting lines of the various players. When all of the players have putted out, one of the players has to bend over and pick up the pin and replace it in the cup. This is repeated for each hole in the round of golf. This repetitive bending over and picking up the pin or flag may be difficult for older golfers. Additionally, when approaching the green, players often have a chip shot then a putt. The player will often bring an iron club along with a putter. In this situation, the club is laid on the fringe of the green or on the green while putting, necessitating bending over and picking up the club after everyone has putted out—another strain on a player's back.

SUMMARY

The present invention relates to an apparatus in combination with a golf flagpole or pin to hold up the flagpole so it does not lie on the ground and does not require the player to bend over to retrieve the flagpole to replace it in the hole. The apparatus includes a collar slidably and rotationally fitted to the shaft of the flagpole. One or two legs are pivotably coupled to the collar and have a first position aligned with the flagpole shaft when the flagpole is in an upright position in the cup, and a second position pivoted away from and supporting the flagpole shaft in an inclined position.

BRIEF DESCRIPTION OF THE DRAWINGS

FIG. 6 is an bottom plan view of the collar of the flagpole stand;

FIG. 7 is a rear elevational view of the collar of the flagpole stand;

DETAILED DESCRIPTION

As required, detailed embodiments of the present invention are disclosed herein. However, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention.

Moreover, except where otherwise expressly indicated, all numerical quantities in this description and in the claims are to be understood as modified by the word "about" in describing the broader scope of this invention. Practice within the numerical limits stated is generally preferred. Also, unless expressly stated to the contrary, the description of a group or class of materials as suitable or preferred for a given purpose in connection with the invention implies that mixtures or combinations of any two or more members of the group or class may be equally suitable or preferred.

Figure 1:
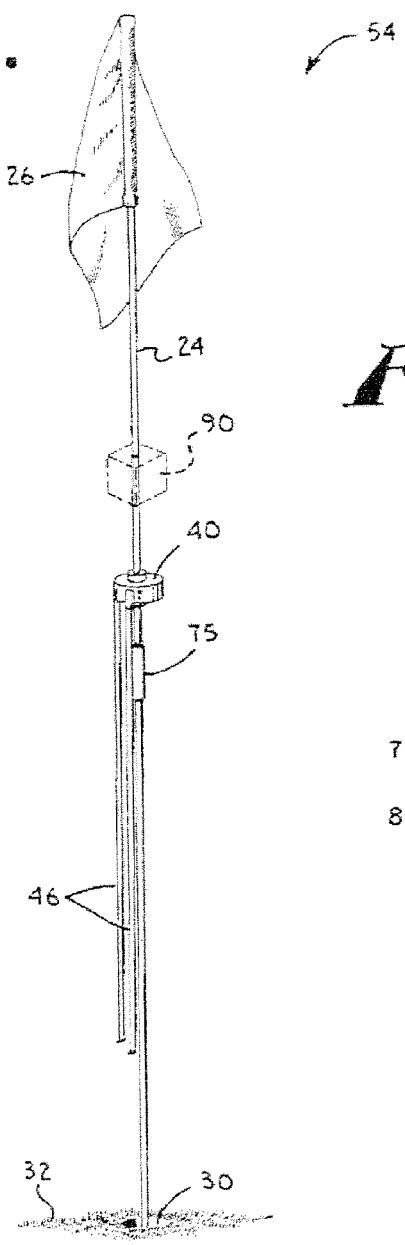
FIG. 1 illustrates a golf flagpole and stand of the present invention supported in the golf hole in an upright position.
Figure 2:
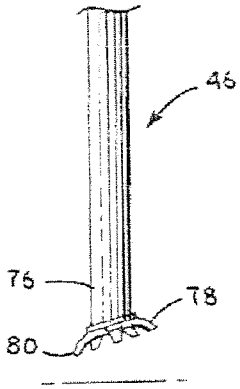
FIG. 2 is an enlarged view of one of the legs of the stand of FIG. 1.

Referring to the figures, an embodiment of the golf flagpole or pin stand is generally indicated by reference numeral 20. The golf flagpole 22 includes a shaft 24, a flag 26 attached to the upper end of the shaft 24 and an adaptor 28 fixed to the lower end of the shaft 24. The adapter 28 is received in the cup 30 in a green 32 to hold the golf flagpole 22 in an upright position 54 (see FIG. 1). When a golfer is putting on the green 32, the flagpole 22 must be removed from the cup 30. The flagpole 22 is typically seven feet tall and marks the cup 30 location in the green 32. The flag 26 includes a number printed on the flag 26 to indicate the hole number.

The golf flagpole stand 20 includes a collar 40 with a pair of cut outs 42 to receive the ends 44 of legs 46. The legs 46 freely pivot about a pin or screw 48 which is countersunk in the side 50 of the collar 40 through the cutouts 42. A spring-biased ball latch 52 may be used to help keep the legs 46 relatively stationary or still when the flagpole 22 is in the upright position 54. The spring-biased ball latch 52 includes a stainless steel ball bearing 56, a compression spring 58 and a set screw 60. The spring-biased ball latch 52 is countersunk in the side 50 of the collar 40 preferably below the pins 48 with a portion of the ball bearing 56 extending into the cutout 42 to make contact with the side 62 of the end 44 of the leg 46. A dimple or seat 64 is machined or pressed into the side 62 of the end 44 of the leg 46 to receive the ball bearing 56. The pressure the spring 58 exerts on the ball bearing 56 may be adjusted as needed by turning the set screw 60 in the appropriate direction, as desired. In this way, the pressure on the sides 62 of the ends 44 of the legs 46 may be increased or decreased to compensate for geographical and weather conditions to keep the legs 46 from swinging in the wind and distract a golfer. For example, a golf course located along a coast using the present invention may experience consistent and higher winds than an inland golf course. Springs 58 with higher spring constants may also be used to increase the pressure on the ball bearing 56, as desired.

The collar 40 includes an aperture 64 which is preferably centered in the collar 40. The aperture 64 is sized to loosely fit around the flagpole shaft 24 so that it may freely rotate or pivot. Upper 66 and lower 68 retainers may be fastened around the flagpole shaft 24 to hold the collar 40 at approximately a midpoint along the flagpole shaft 24. Upper 70 and lower 72 washers provide a bearing surface for the collar 40 to rotate against. The washers are preferably made of nylon or other plastic material.

The flagpole 22 may be removed from the cup 30 by grasping the flagpole shaft 24 just below the collar 40 and lifting the adaptor 28 from the cup 30. A grip 75 may be attached to the flagpole shaft 24 near the center of gravity of the combination of the flagpole 22 and the stand 20. The flag 26 may then be tipped toward the green 32. As the flag 26 is lowered, the collar 40 rotates to a position where the legs 46 are positioned toward the green 32. The rotation occurs because the side of the collar 40 where the legs are attached is heavier than the opposite side. The weight of the legs 46 causes the legs 46 to pivot downwardly away from the flagpole shaft 24, overcoming the pressure of the spring-biased ball latch 52. Because the cutouts 42 are machined perpendicularly to the curved side surface 50 of the collar 40, the legs 46 form an inverted "V" and a tripod with the lower end of the flagpole shaft 24 when extended. The legs 46 extend at an angle of approximately 90° relative to the surface 50 of the collar 40 and to the flagpole shaft 24. The flagpole shaft 24 rests an angle of approximately 45° relative to the surface of the green 32. In this inclined position 74, the flagpole 22 is stable and not laying flat on the green 32. The lower end 76 of each leg 46 may be beveled so as to be relatively flat on the green 32 when in the inclined position 54 and include a base or foot 78 with claws or tines 80 to provide stability to the flagpole stand 20 in the inclined position 74. The location and size of the grip 75 may aid in the placement of the flagpole in the inclined position 74.

Figure 3:
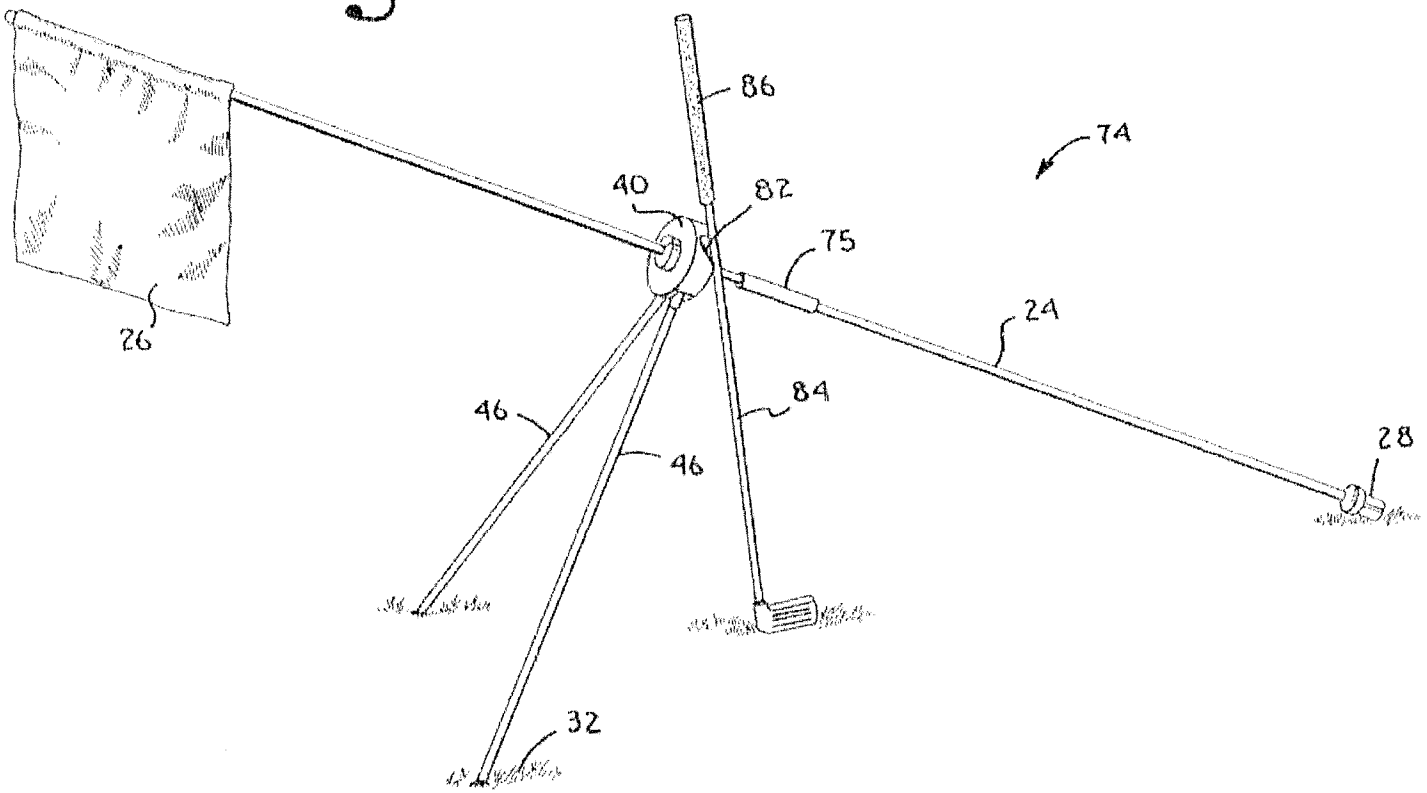
FIG. 3 is the stand of FIG. 1 shown in an inclined position supporting a golf club.
Figure 4:
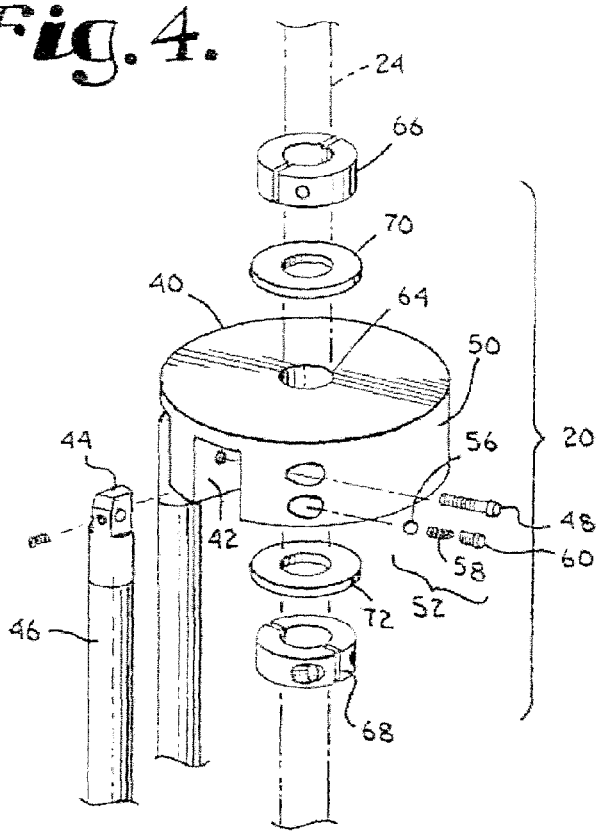
FIG. 4 is an enlarged exploded partial view of the flagpole stand of the present invention.
Figure 5:
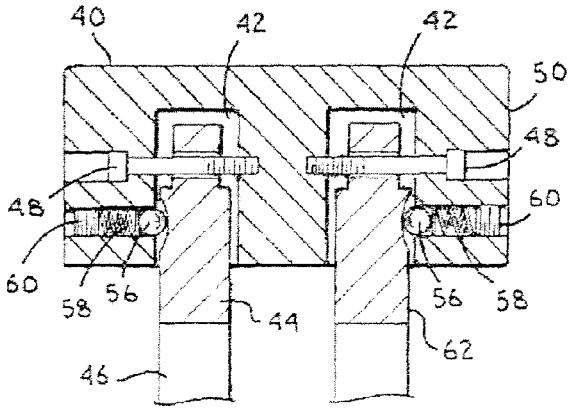
FIG. 5 is a sectional view of the flagpole stand showing the mountings for the legs.

On the side 50 of the collar 40 opposite the cutouts 42 for legs 46, one or two notches 82 may be cut into the collar 40. When in the inclined position 74, the notches 82 may be used to receive the shaft 84 or grip 86 of a golf club 88. The notches 82 are particularly useful when the golfer had a short chip onto the green and was carrying both an iron, such as a 7-iron, for the chip shot and a putter for the putt when the ball is on the green. When putting, the iron 88 may be leaned against the flagpole stand 20, as shown in FIG. 3. In this manner, the club 88 need not be laid on the ground, which would require the golfer to bend over and pick it up after completing the hole. Additionally, by providing a club stand, the club rip 86 does not get wet from lying on the ground.

After the hole is completed, the flagpole shaft 24 may be grasped just under the collar 40. When the flagpole shaft 24 is returned to an upright position 54, the legs 46 swing to a vertical position and snap back into place by the ball latch 52, if present. The weight of the legs 46 in conjunction with the pivot at the ends 44 naturally cause the legs 46 to return to the vertical position when the flagpole 22 is in the upright position 54.

A weather shield or cover 90 may be included to protect the flagpole stand 20 from the weather. The shield 90 may be in the shape of a cube as shown, or cylindrical, for example.

Figure 8:
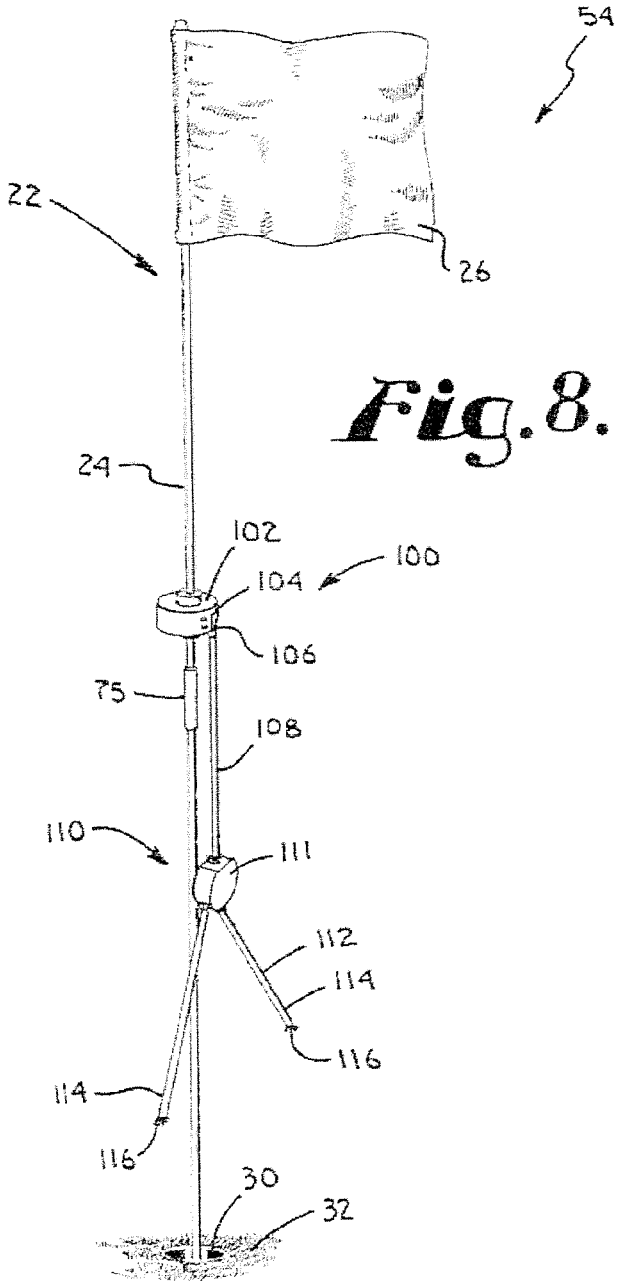
FIG. 8 illustrates an alternate embodiment of a golf flagpole and stand of the present invention supported in the golf hole in an upright position.
Figure 9:
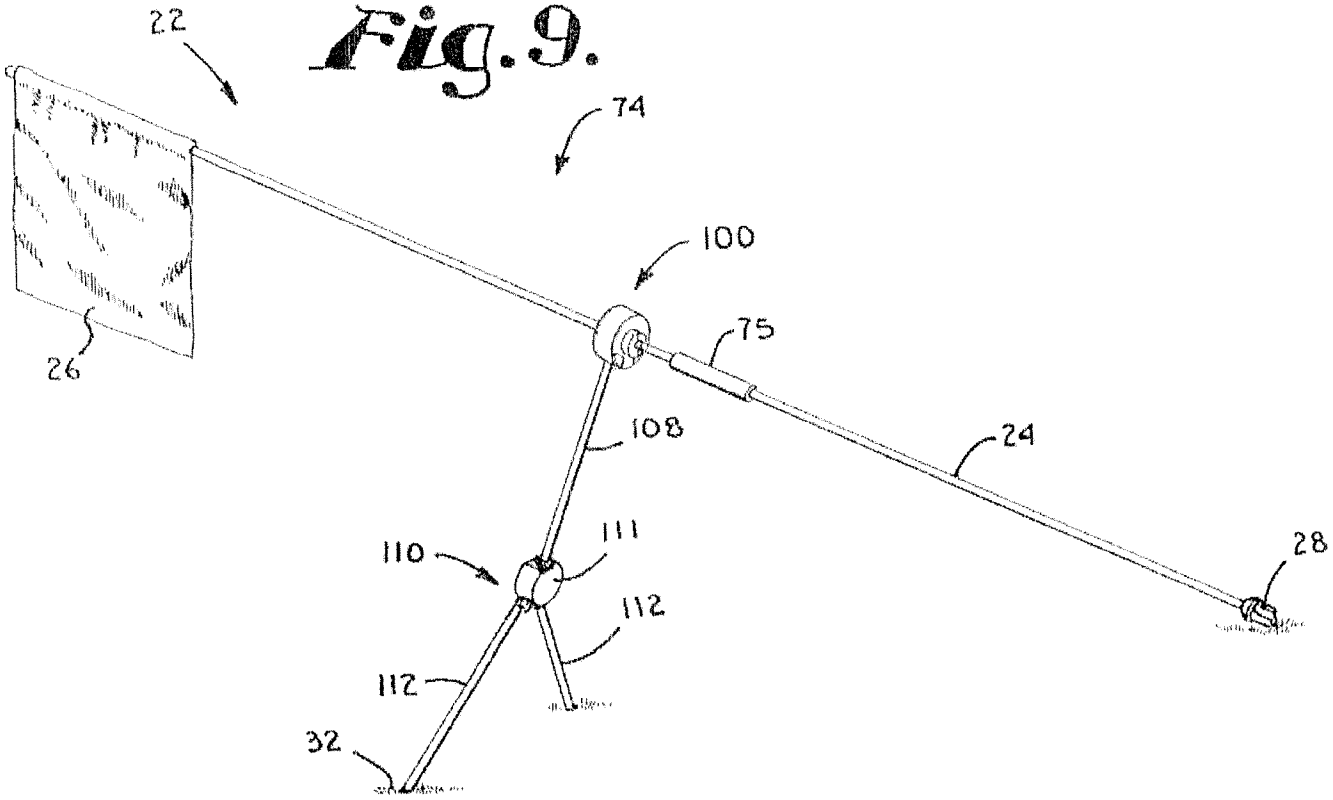
FIG. 9 is the stand of FIG. 8 shown in an inclined position.

Referring to FIGS. 8 and 9, an alternative embodiment of the golf flagpole stand is generally indicated by reference numeral 100. The flagpole stand 100 includes a collar 102, a cutout 104 to receive the end 106 of a leg 108. The leg 108 is free to pivot about a pin or screw (not shown). A spring-biased ball latch (not shown) may also be included to help keep the leg 108 relatively stationary when the flagpole 22 is in an upright position 54. The collar 102 is positioned on the flagpole shaft in a similar manner as described above for the first embodiment.

The leg 108 extends to a base 110 which includes a coupler 111 from which two smaller legs 112 extend outwardly and downwardly forming an inverted "V." It should be understood that other shapes or configurations may be used for a base attached to the leg 108. When the flagpole 22 is removed from the cup 30 by grasping the flagpole shaft 24 just below the collar 102 and lifting the adapter 28 from the cup 30, the flagpole 22 may be placed in the inclined position 74.

As the flag 26 is tipped toward the green 32, the collar 102 may rotate to a position where the smaller legs 112 are positioned toward the green 32. The rotation occurs because the leg 108, coupler 110 and legs 112 are heavier than the other sides of the collar 102. The weight of the coupler 110 and legs 112 cause the leg 108 to pivot away from the flagpole shaft 24, overcoming the pressure of the spring-biased ball latch (not shown). The leg, 108 extends at an angle of approximately 90° relative to the flagpole shaft 24. The flagpole shaft 24 rests at an angle of approximately 45° relative to the surface of the green 32. The lower end 114 of each leg 112 may be beveled so as to be relatively flat on the green 32 when in the inclined position 74 and each includes a foot 116 with claws or tines.

After the hole is completed, the flagpole shaft 24 may be grasped just under the collar 100. When the flagpole shaft 24 is returned to an upright position 54, the leg 108 swings to a vertical position and snaps back into place by the ball latch (not shown). The weight of the leg 108, coupler 110 and lower legs 112 naturally cause the leg 108 to return to the vertical position when the flagpole 22 is in the upright position 54.

Figure 10:
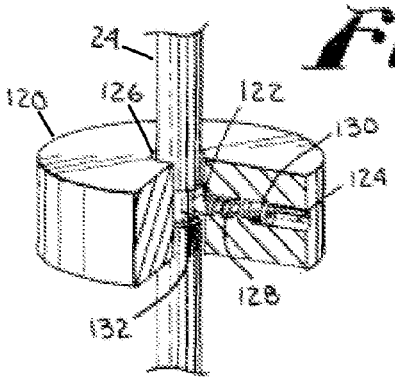
FIG. 10 is a partial sectional view of an alternate embodiment of the collar of the flagpole stand.

Referring to FIG. 10, an alternate embodiment of collar 120 is illustrated with a portion removed to show the mounting details. In this embodiment the collar 120 is secured to the shaft 24 of the flagpole by a ball bearing 122 extending from a bore 124 into the center aperture 126 of the collar 120. The ball bearing 122 is spring biased 128 and held in place with a set screw 130. An annular slot or channel 132 is cut in the flagpole shaft 24 to receive the ball bearing 122. The ball bearing 122 and spring 128 allows the collar 120 to freely turn and pivot on the flagpole shaft 24 and eliminates the additional mounting hardware.

Figure 11:
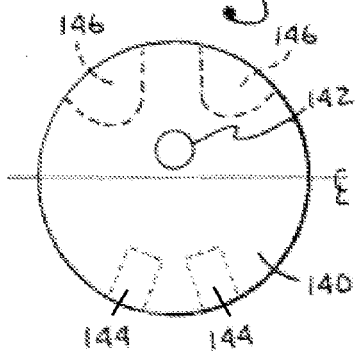
FIG. 11 is a top plan view of an alternate embodiment of the collar of the flagpole stand.

Referring to FIG. 11, another embodiment of a collar 140 is illustrated. The collar 140 is similar to the other collars described above but the aperture 142 is offset away from the cutouts 144 for the legs (not shown) toward the notches 146. The offset aperture 142 provides more mass on the side of the collar 140 with the legs so that the collar 140 more readily pivots or turns when the flagpole is tipped and the legs are deployed.

Figure 12:
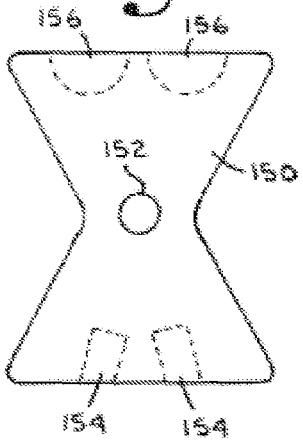
FIG. 12 is a top plan view of an alternate embodiment of the collar of the flagpole stand.
Figure 13:
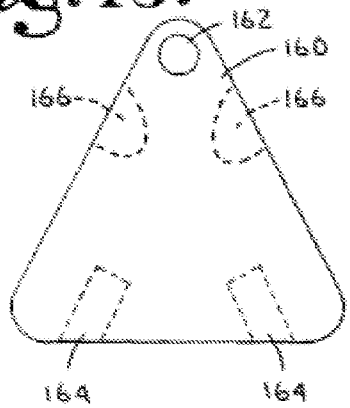
FIG. 13 is a top plan view of an alternate embodiment of the collar of the flagpole stand.

Referring to FIGS. 12 and 13, two more embodiments of a collar 150 and 160 are illustrated, respectively. The collar 150 includes an aperture 152 for receiving the flagpole shaft, cutouts 154 for pivotally receiving the legs, and a pair of notches 156 opposite the cutouts. The collar 160 includes an aperture 162 for receiving the flagpole shaft, cutouts 164 for pivotally receiving the legs, and a pair of notches 166 opposite the cutouts. The shape of the collar is not important and many different configurations and shapes of a collar may be used within the scope of the present invention.

The collar 40 (140, 150 and 160) is preferably made of aluminum or stainless steel for durability and to resist corrosion. Other materials may be used such as rubber, high density plastic or epoxy resins, for example. The legs 46 may be made of aluminum, Fiberglas, or PVC plastic, for example, with stainless steel or aluminum ends 44 for durability.

It is to be understood that while certain now preferred forms of this invention have been illustrated and described, it is not limited thereto except insofar as such limitations are included in the following claims.

Having thus described the invention, what is claimed as new and desired to be secured by Letters Patent is as follows:

1. A stand for a golf flagpole, the golf flagpole having a shaft having two ends, a flag secured to one end of the shaft and an adapter secured to the other end of the shaft and adapted to be received in a cup on a golf putting green and support the golf flagpole in an upright position, said stand comprising:

a collar having an aperture for receiving said shaft of the golf flagpole; said collar adapted to freely rotate on the shaft;

a first leg having a first end pivotably coupled to said collar and a second end opposite said first end, said first leg extending downwardly and generally parallel to the shaft in a first position when the golf flagpole is in the upright position;

a base secured to said second end of said first leg; and a spring-biased latch secured to said collar and coupled to said first end of said first leg, said spring-biased latch releasably retaining said first leg in said first position when the golf flagpole is in the upright position;

whereas said first leg pivots from said first position when the golf flagpole is in the upright position to a second extended position when the golf flagpole is pulled from the cup in the putting green and the flag is tipped toward the putting green;

whereas said collar rotates about said shaft so that said first leg extends toward the putting green; and whereas said first leg extends generally perpendicularly from the shaft and said base supports the golf flagpole in an inclined position on the putting green.

2. The stand of claim 1 wherein said base includes a coupler and a pair of legs extending from said coupler in a generally inverted V-shaped configuration.

3. The stand of claim 1 further comprising a second leg having a first end pivotably coupled to said collar proximal said first end of said first leg and a second end opposite said first end; said second leg extending downwardly and generally parallel to the shaft in a first position when the golf flagpole is in the upright position; and whereas said first leg and said second leg pivot from said first position when the golf flagpole is in the upright position to said second position when the golf flagpole is pulled from the cup in the putting green and the flag is tipped toward the putting green;

whereas said first leg and said second leg extend generally perpendicularly from the shaft to support the golf flagpole in an inclined position on the putting green;

whereas said collar rotates about said shaft so that said first and second legs extend toward the putting green; and whereas said first leg and said second leg present a generally inverted V-shaped configuration and form a tripod configuration with the adapter of the golf flagpole.

4. The stand of claim 3 wherein each of said second ends of said first and second legs includes a foot for contact with the putting green in said second position.

5. The stand of claim 1 further comprising an at least one notch in a side of said collar opposite said first leg for receiving and supporting a golf club when said stand is in the inclined position.

6. The stand of claim 1 further comprising a first retainer secured to the shaft of the flagpole below said collar and a second retainer secured to the shaft of the flagpole above said collar to retain said collar at a desired position on the shaft.

7. The stand of claim 1 further comprising a cover secured to the shaft at a location along the shaft that is higher than said collar to provide limited protection for said collar.

8. The stand of claim 1 further comprising a spring-biased ball bearing extending into said aperture from an outer surface of said collar, said spring-biased ball bearing extending into an annular channel cut in the surface of the flagpole shaft at a desired height, whereas said spring-biased ball bearing rotatably couples said collar to the flagpole shaft at said desired height.

9. The stand of claim 1 further comprising a grip secured to the shaft of the flagpole near the center of gravity of the flagpole and said stand to aid in placing said stand in said second position.

10. The stand of claim 1 wherein said aperture is centered through said collar.

11. The stand of claim 1 wherein said aperture is off-center through said collar.

12. A stand for a golf flagpole, the golf flagpole having a shaft having two ends, a flag secured to one end of the shaft and an adapter secured to the other end of the shaft and adapted to be received in a cup on a golf putting green and support the golf flagpole in an upright position, said stand comprising:

a collar having an aperture for receiving the shaft of the golf flagpole, and a pair of notches on a first side of said collar, said collar adapted to freely rotate on the shaft;

a pair of legs each having a first end pivotably coupled to said collar on a second side opposite said notches, and a second end opposite said first end, said legs extending downwardly and generally parallel to the shaft in a first position when the golf flagpole is in the upright position; and a pair of spring-biased latches secured to said collar and one of each coupled to said first ends of said first and second legs, said spring-biased latches releasably retaining said first and second legs in said first position when the golf flagpole is in the upright position;

whereas said pair of legs pivot from a said first position when the golf flagpole is in the upright position to a second position when the golf flagpole is pulled from the cup in the putting green and the flag is tipped toward the putting green;

whereas said collar rotates about said shaft so that said first and second legs extend toward the putting green in said second position; and whereas said pair of legs each extend generally perpendicularly from the golf flagpole shaft forming a generally inverted "V" with respect to each other.

13. The stand of claim 12 further comprising a first retainer secured to the shaft of the flagpole below said collar and a second retainer secured to the shaft of the flagpole above said collar to retain said collar at a desired position on the shaft.

14. The stand of claim 12 further comprising a cover secured to the shaft at a location along the shaft that is higher than said collar to provide limited protection for said collar.

15. The stand of claim 12 further comprising a spring-biased ball bearing extending into said aperture from an outer surface of said collar, said spring-biased ball bearing extending into an annular channel cut in the surface of the flagpole shaft at a desired height, whereas said spring-biased ball bearing rotatably couples said collar to the flagpole shaft at said desired height.

16. The stand of claim 12 further comprising a grip secured to the shaft of the flagpole near the center of gravity of the flagpole and said stand to aid in placing said stand in said second position.

17. The stand of claim 12 wherein said aperture is centered through said collar.

18. The stand of claim 12 wherein said aperture is off-center through said collar.

* * * * *